US007900405B1

(12) United States Patent
Jacoby

(10) Patent No.: US 7,900,405 B1
(45) Date of Patent: Mar. 8, 2011

(54) SPHERICAL DOME

(76) Inventor: John Donald Jacoby, Ketchum, ID (US)

( * ) Notice: Subject to any disclaimer, the term of this patent is extended or adjusted under 35 U.S.C. 154(b) by 0 days.

(21) Appl. No.: 12/924,081

(22) Filed: Sep. 20, 2010

(51) Int. Cl.
*E04B 7/08* (2006.01)

(52) U.S. Cl. ..... 52/81.3; 52/80.1; 52/80.2; 52/745.07; 52/200; 52/664; 210/163; 220/213

(58) Field of Classification Search ..... 52/80.1, 52/80.2, 81.1, 81.2, 81.3, 745.07, 82, 200, 52/664, 665, 655.2, 106; D25/18, 56; 210/163, 210/474, 499; 220/213, 320, 319, 315, 370; 119/452
See application file for complete search history.

(56) References Cited

U.S. PATENT DOCUMENTS

| | | | | | |
|---|---|---|---|---|---|
| 1,510,910 | A | * | 10/1924 | Wills | 210/471 |
| 1,645,818 | A | * | 10/1927 | Overboe et al. | 210/495 |
| 2,682,235 | A | | 6/1954 | Fuller | |
| 2,978,074 | A | * | 4/1961 | Schmidt | 52/81.2 |
| 3,006,670 | A | * | 10/1961 | Schmidt | 403/55 |
| 3,137,371 | A | * | 6/1964 | Nye | 52/81.2 |
| 3,220,152 | A | * | 11/1965 | Sturm | 52/655.2 |
| 3,392,495 | A | * | 7/1968 | Ahern et al. | 52/81.4 |
| 3,788,485 | A | * | 1/1974 | Bruning | 210/474 |
| 3,889,433 | A | * | 6/1975 | Eubank, Jr. | 52/86 |
| 4,026,078 | A | * | 5/1977 | Ahern et al. | 52/81.4 |
| 4,068,422 | A | * | 1/1978 | Sumner | 52/81.2 |
| 4,146,997 | A | * | 4/1979 | Diethorn | 52/81.4 |
| 4,182,086 | A | | 1/1980 | Crooks | |
| 4,452,025 | A | * | 6/1984 | Lew | 52/668 |
| 5,069,009 | A | | 12/1991 | Suzuki | |
| 5,527,590 | A | * | 6/1996 | Priluck | 428/198 |
| 5,907,931 | A | * | 6/1999 | Sun | 52/81.4 |
| 6,076,318 | A | * | 6/2000 | Grimm et al. | 52/245 |
| 6,108,984 | A | * | 8/2000 | Davidson | 52/81.1 |
| 6,134,849 | A | * | 10/2000 | Holler | 52/80.1 |
| 6,276,095 | B1 | * | 8/2001 | Tripsianes | 52/81.1 |
| 6,658,800 | B2 | * | 12/2003 | Monson et al. | 52/81.1 |
| 6,996,942 | B2 | * | 2/2006 | Geiger | 52/81.3 |
| 7,389,612 | B1 | * | 6/2008 | Fischbeck | 52/81.1 |
| 7,458,186 | B2 | * | 12/2008 | Carter | 52/81.1 |
| 7,574,830 | B2 | * | 8/2009 | Baker | 52/2.18 |
| 2002/0078635 | A1 | * | 6/2002 | Monson et al. | 52/81.1 |
| 2006/0000786 | A1 | * | 1/2006 | Tueshaus et al. | 210/767 |
| 2006/0288950 | A1 | * | 12/2006 | Cartwright et al. | 119/223 |
| 2007/0151170 | A1 | * | 7/2007 | Carter | 52/81.1 |
| 2007/0251161 | A1 | * | 11/2007 | Tuczek | 52/80.1 |
| 2008/0066393 | A1 | * | 3/2008 | Sorensen | 52/81.1 |
| 2008/0220899 | A1 | * | 9/2008 | Sullivan et al. | 473/372 |

* cited by examiner

*Primary Examiner* — Robert J Canfield
*Assistant Examiner* — Matthew J Gitlin

(57) ABSTRACT

The invention is a spherical dome consisting of continuous prismatic members in three layers, an outer layer, a middle layer, and an inner layer. The continuous prismatic members follow great circle arcs. The members of the three layers form a three-way grid, crossing at the vertices of contiguous spherical triangles. Three members, one from each layer, are connected together at each vertex with fasteners, such as bolts, rivets, or welds.

The continuous prismatic members of each layer can be spaced as desired to provide structural integrity, economy, and simplicity of construction. A tension ring, when required structurally, is provided at the bottom periphery of the dome to resist the vertical and horizontal forces generated by the supported loads. The combined elements provide a simple and economical spherical dome.

9 Claims, 4 Drawing Sheets

SPHERICAL DOME

FIELD OF THE INVENTION

The present invention relates to dome structures and, more particularly, to dome structures with intersecting members to form contiguous spherical triangles.

BACKGROUND OF THE INVENTION

The construction of spherical domes has a long history. There are many types of spherical domes constructed of materials such as reinforced concrete, foam, structural steel, and even ice. Reinforced concrete and foam type domes typically require the use of forms. Structural steel domes typically require many members and connections. Of course, ice is typically used in the construction of igloos, a special case of domes.

It is desirable to provide economical and simple construction for domes, especially larger domes. Costly and complex designs and construction have often been used, however there are many cases where simplicity and economy are desired and needed.

Aesthetics, of course, is usually an important factor, but do not necessarily require costly, complex designs and construction. There are many aesthetic dome designs. Many of them have strived for simplicity and economy, parameters which are difficult to achieve.

Domes date back thousands of years. There have been Roman, Persian, Arabic, Western-European, Italian Renaissance, Ottoman, Russian, Indian, and Islamic domes.

There are many types of domes, including corbel domes, onion domes, oval domes, parabolic domes, polygonal domes, sail domes, saucer domes, and umbrella domes.

In more recent times, noted domes are the Saint Paul's Cathedral dome, the United States Capitol building dome, the Astrodome, and the SkyDome. There are many other influential and famous domes, too numerous to mention.

In the present time, there have been many domes constructed based upon the concepts of Richard Buckminster Fuller's U.S. Pat. No. 2,682,235, "Building Construction", Jun. 29, 1954. Another patent by Richard Buckminster Fuller, U.S. Pat. No. 3,197,927, "Geodesic Structures", Aug. 3, 1965, utilizes the concepts of his "Building Construction" patent. Other patents have been found which attempt to address the complexities of domes. One is a patent by Melvin Crooks, U.S. Pat. No. 4,182,086, "Building Construction of A-Shaped Elements", Jan. 8, 1980. It is a worldwide desire to simplify domes, as evidenced by an inventor from Japan, Toshiro Suzuki, U.S. Pat. No. 5,069,009, "Shell Structure and Method of Constructing", Dec. 3, 1991.

Despite the striving for simplicity and economy, combined with aesthetics, domes continue to be quite complex and costly. Almost all domes, especially the larger ones, remain difficult to build, some of them requiring shoring, such as the case for concrete domes, and some of them require many different parts and connections, such as the case for structural steel domes. Even geodesic domes have many and complex parts and connections. Complexity with resultant high costs seem to be inherent in such structures.

The "Spherical Dome", as hereafter described, solves the problem of complexity, providing a simple, aesthetic, and economical solution.

SUMMARY OF THE INVENTION

In accordance with the present invention, there is provided a spherical dome consisting of continuous prismatic members in three layers, an outer layer, a middle layer, and an inner layer. The continuous prismatic members follow great circle arcs. The members of the three layers form a three way grid, crossing at the vertices of contiguous spherical triangles. Three members, one from each layer, are connected together at each vertex with fasteners, such as bolts, rivets, or welds. The members of each layer can be spaced as desired to provide structural integrity, economy, and simplicity of construction.

A tension ring, when required structurally, is provided at the bottom periphery of the dome to resist the vertical and horizontal forces generated by the supported loads. The combined elements provide a simple and economical spherical dome.

It would be advantageous to provide a spherical dome.

It would also be advantageous to provide a spherical dome simple to construct.

It would further be advantageous to provide a spherical dome with simple members and connections to provide economy of construction.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT

Figure 1:
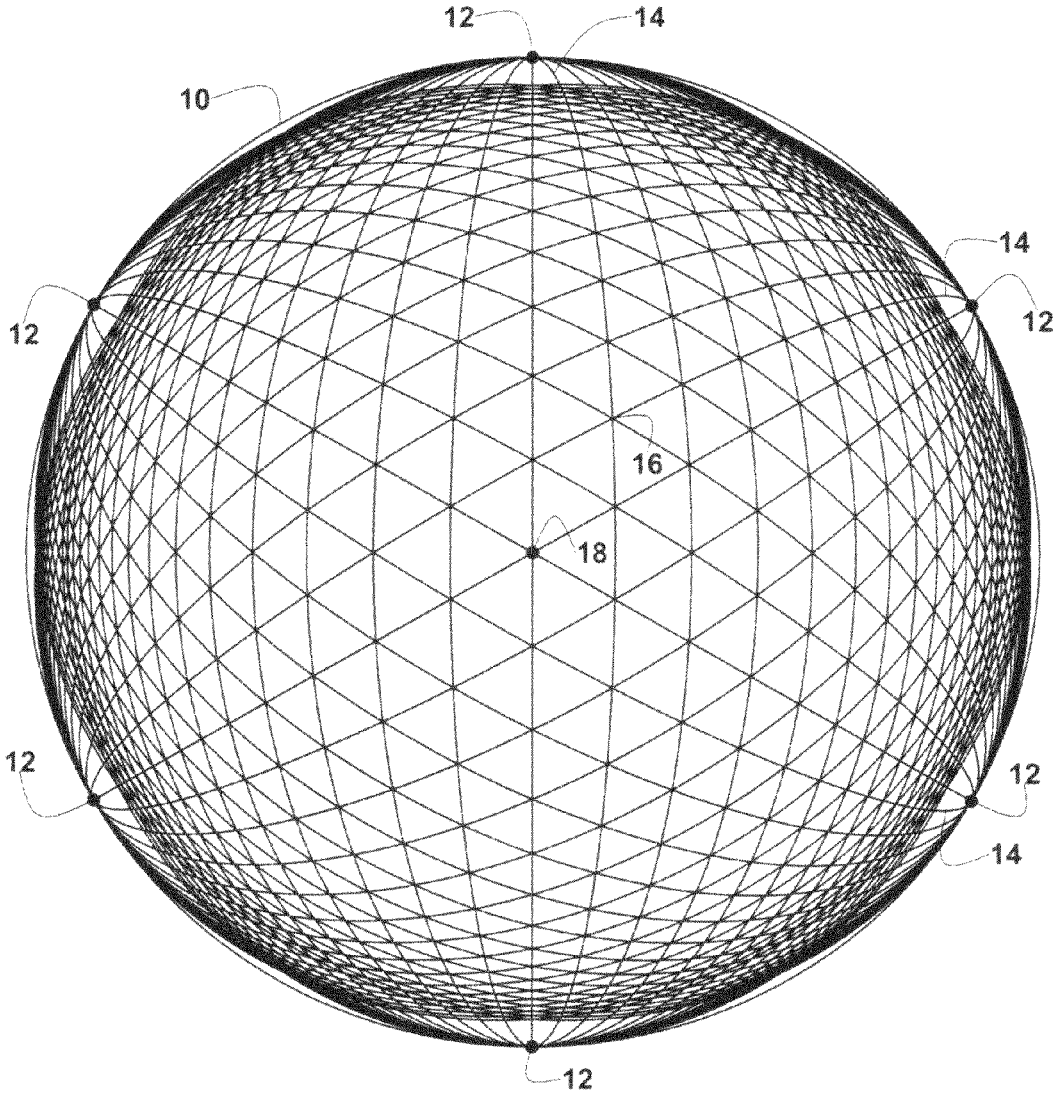
FIG. 1 is a plan view of a three-way spherical grid pattern.

FIG. 1, a plan view of a three-way spherical grid pattern, shows an equatorial circle 10, a polar node 12 at six locations, great circle arcs 14, vertices of contiguous spherical triangles 16, and a central polar node 18.

To form the three-way spherical grid pattern, an equatorial circle 10 is the base. A polar node 12 is located at each of six locations, sixty degrees apart, along the equatorial circle 10. The great circle arcs 14 connect one polar node 12 to an opposite polar node 12. The great circle arcs 14 are spaced as desired for greater or less density of great circle arcs 14. They are also spaced to intersect at the vertices of contiguous spherical triangles 16. The central polar node 18 is located vertically above the center of the equatorial circle 10 and at the intersection of three great circle arcs 14.

As described, the grid of great circle arcs 14 lies within the surface of a coincident sphere. As shown, the frequency of great circle arcs 14 becomes greater toward the equatorial circle 10. In fact, if the great circle arcs 14 were made to cover the entire sphere, there would be an infinite number of them, along with an infinite number of spherical triangles.

It should be noted that the projection of the great circle arcs 14 upon the plane of the equatorial circle 10 are ellipses, except for the great circle arcs 14 passing through the central polar node 18. In that case, the projection of those three great circle arcs 14 upon the plane of the equatorial circle 10 are straight lines. Of course, the projection of the central polar node 18 upon the plane of the equatorial circle 10 is a node at the center of the equatorial circle 10.

The plan view of the three-way spherical grid pattern was drawn using lines and ellipses and nodes on a plane surface. The equatorial circle 10 with a polar node 12 located at each of six locations, sixty degrees apart were drawn. Three lines, each line connecting opposite polar nodes were drawn. Then three ellipses, nearest the three lines, were drawn using the three lines as their major axes and setting the minor axes as desired. Next, three more ellipses were drawn, using the same three lines as their major axes, but passing through the vertices of triangles formed by the first three ellipses. Similarly, the remaining ellipses were drawn.

Figure 2:
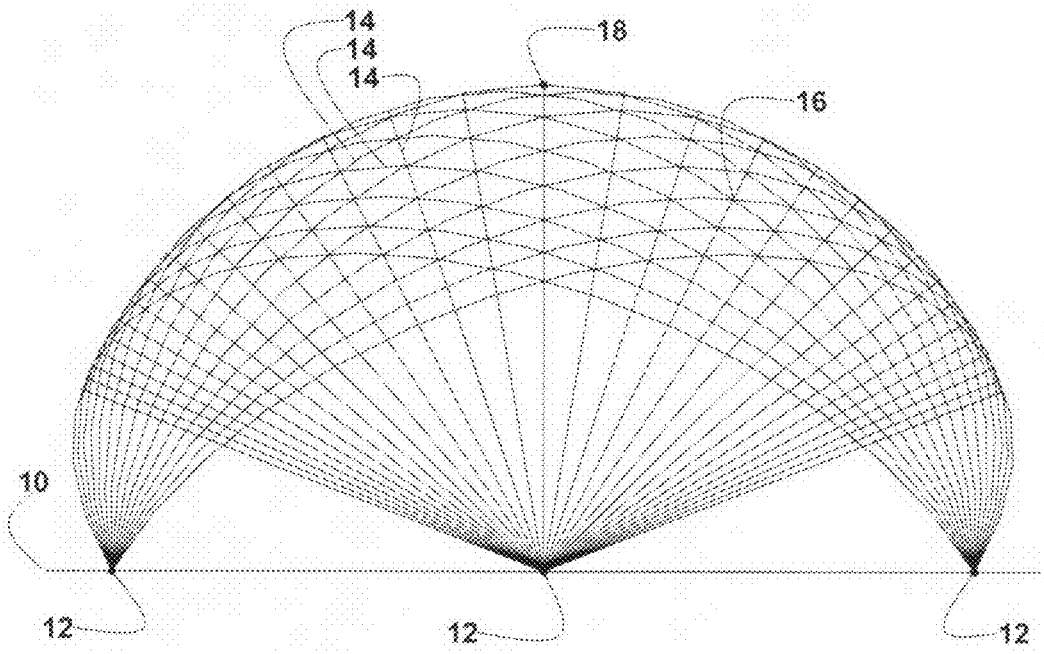
FIG. 2 is a front elevation view of a three-way spherical grid pattern.

FIG. 2, a front elevation view of a three-way spherical grid pattern, shows an equatorial circle 10, a polar node 12 at three locations, great circle arcs 14, vertices of contiguous spherical triangles 16, and a central polar node 18.

The previous description of FIG. 1 describes how to form the three-way spherical grid pattern. FIG. 2 shows a polar node 12 at three locations, however it should be understood that there is a polar node 12 at six locations, as described for FIG. 1. Three of the polar node 12 locations are at the far side of the dome, directly behind the three shown. The description of FIG. 1 states that the frequency of the great circle arcs 14 becomes greater toward the equatorial circle 10. This is quite evident in FIG. 2 by noting the spacing of the great circle arcs 14 emanating from the middle polar node 12 of the front elevation. The spacing becomes increasingly smaller as the equatorial circle 10 is approached. The spacing becomes smaller and smaller and as stated previously, the number of great circle arcs 14 and the number of spherical triangles would become infinite if all of the great circle arcs 14 were shown.

FIG. 1 and FIG. 2, along with their descriptions, have shown how the three-way spherical grid pattern is generated.

Figure 3:
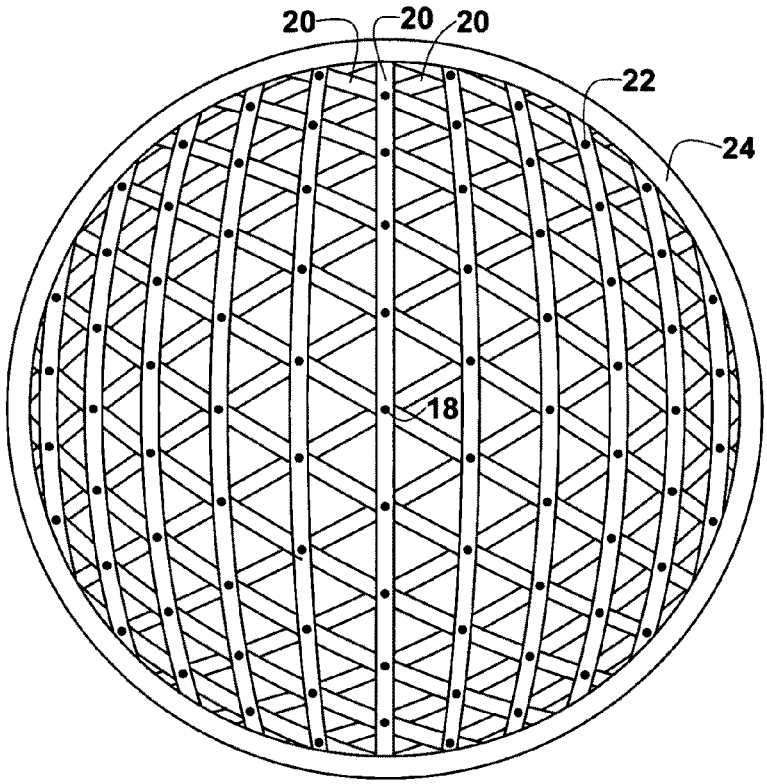
FIG. 3 is a plan view of a spherical dome.

FIG. 3 is a plan view of a spherical dome. As in FIG. 1, the central polar node 18 is shown. A plurality of continuous prismatic members 20 are shown in three layers. At the intersections of the members are shown a plurality of fasteners 22 connecting the members of the three layers. At the bottom periphery of the dome is a tension ring 24.

The centroids of the plurality of continuous prismatic members 20 of the outer layer are coincident with the great circle arcs 14 depicted in FIG. 1. The centroids of the plurality of continuous prismatic members 20 of the middle layer are radially offset, inwardly, from the outer great circle arcs 14 by the thickness of the members. Similarly, the centroids of the plurality of continuous prismatic members 20 of the inner layer are radially offset, inwardly, from the outer great circle arcs 14 by twice the thickness of the members. The plurality of continuous prismatic members 20 of the three layers cross at the vertices of contiguous spherical triangles 16 as depicted in FIG. 1. A plurality of fasteners 22 rigidly connect the members at their intersections, as shown.

For the embodiment of the dome, shown in FIG. 3, the plurality of continuous prismatic members 20 are metallic flat bars, rectangular in cross section, and bent about their weaker minor axes. It is required to have the members follow great circle paths to assure that the members will be bent about their weaker minor axes, only. Optionally, the plurality of continuous prismatic members 20 could be non-metallic flat bars. The plurality of fasteners 22 are bolts. Of course, it is understood that bolts require nuts with optional washers.

Metallic flat bars could be made from steel, aluminum, copper, or other metals. Non-metallic flat bars could be made from wood, plastic, fiberglass, or other non-metal. Other fasteners that could be used are rivets, welding, wood fasteners, or adhesives. Fasteners used would be compatible with the metallic or non-metallic flat bars.

For the embodiment of the dome, shown in FIG. 3, if its bottom radius is known and its slope angle relative to horizontal at the bottom of the dome is known, the radius of the equatorial circle 10 of FIG. 1 can easily be determined. The radius of the equatorial circle 10 is equal to the bottom radius of the dome of FIG. 3 divided by the sine of the slope angle. As an example, assume that the bottom radius desired is twenty feet and the slope angle desired is thirty degrees. The sine of thirty degrees is 0.50. Dividing twenty feet by 0.50 would give the radius of the equatorial circle 10 equal to forty feet. Using that radius, the three-way grid pattern of FIG. 1 would have a spherical radius of forty feet. The great circle arcs 14, as well as the equatorial circle 10 would have a radius of forty feet.

Another dimensional consideration is the distance between the vertices of contiguous spherical triangles 16. This is important, since certain fasteners, such as bolts, require holes through the plurality of continuous prismatic members 20 at those vertices. The location of those holes must be accurate to assure proper assembly. It should be noted that the distances between the vertices of contiguous spherical triangles 16 are not all equal. However, the distances can be mathematically determined and the holes accurately located with modern machines, such as laser cutters. With properly located holes, the assembly of the spherical dome requires no further measurements. It should be noted that the distances between the holes of the middle layer and the distances between the holes of the inner layer are proportional to the radii of those layers with respect to the radius of the outer layer.

Figure 4:
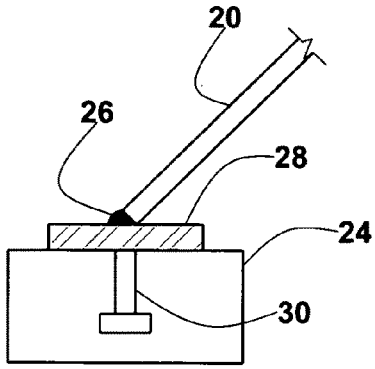
FIG. 4 is a cross section view of a spherical dome connection.

FIG. 4 shows a cross section view of a spherical dome connection. One of the plurality of continuous prismatic members 20 is shown fastened to the tension ring 24 with a weld 26 to a plate 28 fastened to the tension ring 24. In the case shown, the tension ring 24 is concrete and the plate 28 is fastened to the tension ring 24 with end-welded headed studs 30 as required. Concrete reinforcement is not shown, but would be designed to resist the applied forces from the dome. If the tension ring 24 were made from wood, wood screws, lag screws, bolts or other wood fasteners could be used to connect the plate 28 to the tension ring 24. Although not indicated, it would be best if the centroids of the plurality of continuous prismatic members 20 intersected the centroid of the tension ring 24, to minimize any imposed torsion on the tension ring 24. Of course, if the tension ring 24 were made of steel, the weld 26 could be directly to the steel member.

Figure 5:
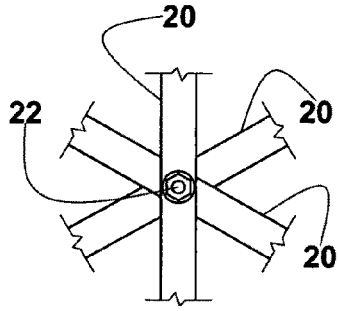
FIG. 5 is a plan view of a spherical dome connection.

FIG. 5 is a plan view of a spherical dome connection. Three of the plurality of continuous prismatic members 20 are shown, in three layers, crossing at the vertex of a spherical triangle and connected by one of a plurality of fasteners 22. The fastener shown in this view is a bolt with a nut and washers. Other fasteners, as described previously, could be used as desired.

Figure 6:
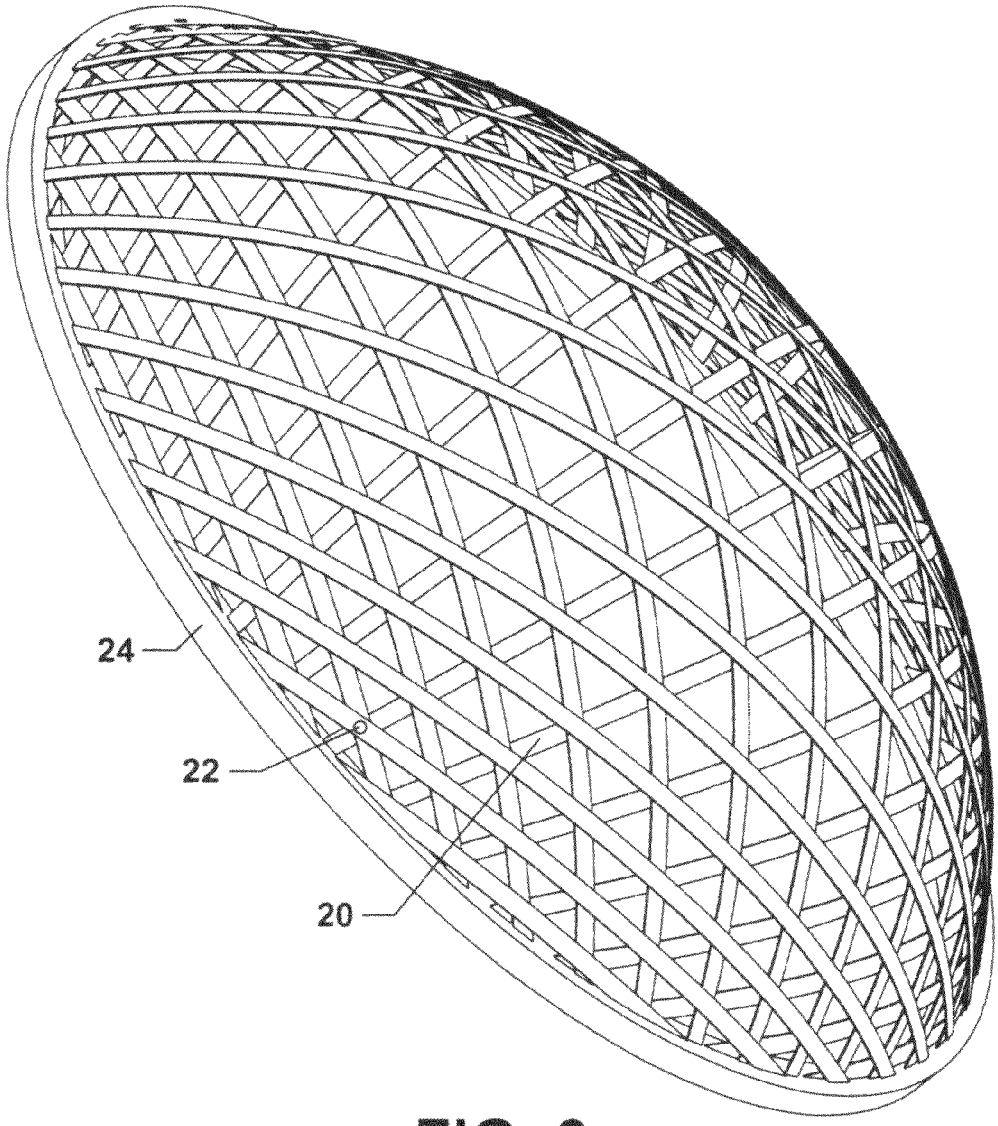
FIG. 6 is a perspective view of a spherical dome.

FIG. 6, a perspective view of a dome, as described in these specifications and in FIG. 1 to FIG. 5, inclusive, shows the simplicity of the construction. The plurality of continuous prismatic members 20, one of the plurality of fasteners 22, and the tension ring 24 are shown.

The spherical dome, as described in these specifications and depicted in the drawings, could be used for a building structure, a skylight, or other enclosure, such as a gazebo, a greenhouse, or an arbor. One of the major advantages is that, in a pre-assembly state, the entire structure can be packaged very compactly. The plurality of continuous prismatic members 20, not necessarily prebent, especially in the form of flat bars, would be part of such a compact package. The plurality of fasteners 22, such as standard bolts, nuts, and washers, could come in a compact box. Delivered to the building site, the spherical dome could be rapidly erected.

In the case of the spherical dome being required to provide shelter from the elements, it could be covered with one of the modern fabrics. Other types of rigid coverings could also be used.

One type of fastener, which could provide much versatility for fastening material to the inner surface and/or outer surface of the spherical dome, could be a special bolt, described as follows. It would be a standard headed bolt with a threaded portion, but with an additional threaded portion on the opposite side of the bolt head. With such a bolt, the three layers of the plurality of continuous prismatic members 20 would be bolted together with one threaded portion. That threaded portion could extend beyond the nut, to accept a material fastened with another nut. The additional threaded portion on the opposite side of the bolt head could accept another material fastened with a third nut. With such a plurality of fasteners 22, materials could be bolted to both the inner surface of the dome and to the outer surface of the dome.

Another type of fastener, similar to the previous one described, could be a threaded rod, long enough to accept four nuts with washers and to fasten the plurality of continuous prismatic members 20 along with other attached materials.

The spherical dome, as described, could have form material attached to the inner surface of the dome. It could serve as a form for materials, such as concrete or foam. The dome members could serve as the reinforcement and additional reinforcing steel bars or mesh could be added, as required. The spherical dome, as described, along with concrete would have additional structural strength.

Recapping, the "Spherical Dome", as described herein, provides a simple and economical solution to dome construction. All members, as shown in the figures and described as a plurality of continuous prismatic members 20, such as the standard in-stock steel flat bars, could have the same cross section. All fasteners can be standard fasteners, such as bolts, and described as a plurality of fasteners 22. The optional tension ring 24, if required structurally, is typical standard construction. Of course, all elements should be sized to support all of their own weight plus the weight of any superimposed loading.

It does not seem that a structural dome could be constructed much more simply than described.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A spherical dome for providing a building structure, skylight, or other enclosure, comprising:

a plurality of continuous prismatic members, following great circle arcs and combining, in three spherically concentric layers to cross at the vertices of contiguous spherical triangles; and a plurality of fasteners, fastening said plurality of continuous prismatic members at the vertices of contiguous spherical triangles, rigidly connected to said plurality of continuous prismatic members.

2. The spherical dome as recited in claim 1, further comprising:

a tension ring, resisting vertical and horizontal forces at the bottom periphery of the dome, rigidly connected to said plurality of continuous prismatic members.

3. The spherical dome as recited in claim 1, wherein said plurality of continuous prismatic members has characteristics selected from the following group: metallic flat bars with a rectangular cross section, and non-metallic flat bars with a rectangular cross section.

4. The spherical dome as recited in claim 1, wherein said plurality of fasteners has characteristics selected from the following group: bolts, rivets, welding, wood fasteners, and adhesives.

5. The spherical dome as recited in claim 2, wherein said plurality of continuous prismatic members has characteristics selected from the following group: metallic flat bars with a rectangular cross section, and non-metallic flat bars with a rectangular cross section.

6. The spherical dome as recited in claim 2, wherein said plurality of fasteners has characteristics selected from the following group: bolts, rivets, welding, wood fasteners, and adhesives.

7. The spherical dome as recited in claim 2, wherein said tension ring has characteristics selected from the following group: steel, reinforced concrete, and wood.

8. The spherical dome as recited in claim 5, wherein said tension ring has characteristics selected from the following group: steel, reinforced concrete, and wood.

9. The spherical dome as recited in claim 6, wherein said tension ring has characteristics selected from the following group: steel, reinforced concrete, and wood.

* * * * *